US011441868B2

(12) United States Patent
Martino

(10) Patent No.: US 11,441,868 B2
(45) Date of Patent: Sep. 13, 2022

(54) SLINGSHOT FOOTBALL

(71) Applicant: Marc Gregory Martino, Westlake Village, CA (US)

(72) Inventor: Marc Gregory Martino, Westlake Village, CA (US)

( * ) Notice: Subject to any disclaimer, the term of this patent is extended or adjusted under 35 U.S.C. 154(b) by 274 days.

(21) Appl. No.: 15/130,161

(22) Filed: Apr. 15, 2016

(65) Prior Publication Data

US 2016/0303459 A1 Oct. 20, 2016

Related U.S. Application Data

(60) Provisional application No. 62/147,604, filed on Apr. 15, 2015, provisional application No. 62/149,500, filed on Apr. 17, 2015, provisional application No. 62/151,845, filed on Apr. 23, 2015.

(51) Int. Cl.

| | |
|---|---|
| ***F41B 3/02*** | (2006.01) |
| ***A63B 65/12*** | (2006.01) |
| ***A63B 43/00*** | (2006.01) |

(52) U.S. Cl.

CPC ..... *F41B 3/02* (2013.01); *A63B 43/002* (2013.01); *A63B 43/007* (2013.01); *A63B 65/122* (2013.01); *A63B 2225/01* (2013.01)

(58) Field of Classification Search

CPC ..... A63B 69/407; F41B 3/02; F41B 5/1484; F41B 5/0094; A63F 9/0269; A63F 2009/0282; F42B 6/02

See application file for complete search history.

(56) References Cited

U.S. PATENT DOCUMENTS

| | | | | | |
|---|---|---|---|---|---|
| 2,525,332 | A * | 10/1950 | Alger | F42B 6/06 | 473/586 |
| 3,494,346 | A * | 2/1970 | Yount | F41B 3/02 | 124/20.1 |
| 5,269,514 | A * | 12/1993 | Adler | A63B 43/002 | 273/DIG. 20 |
| 5,807,198 | A * | 9/1998 | Grimm | A63B 65/00 | 473/613 |
| 6,042,494 | A * | 3/2000 | Rappaport | A63B 43/002 | 473/613 |
| 6,120,398 | A * | 9/2000 | Myers | A63B 43/00 | 473/613 |
| 7,874,947 | B1 * | 1/2011 | Wolfinbarger | A63H 33/18 | 473/578 |
| D692,065 | S * | 10/2013 | Williams | D21/387 | |

(Continued)

*Primary Examiner* — Steven B Wong

(74) *Attorney, Agent, or Firm* — Hackler Daghighian Marino & Novak

(57) ABSTRACT

A launching and/or catching toy kit has a football and at least one associated slingshot. The football includes a generally elongated spheroidal body, a support non-movably attached to the body, a tail, and a first and a second elastic band hook oppositely disposed. The slingshot is configured to launch the football from a first user to a second user. The slingshot includes a handle and a pair of prongs connected and/or extending from the handle top. At least one elastic band is connected to each prong. Each of the at least one elastic bands are releasably captured by their respective first or second elastic band hook on the football during launching by the first user. When two slingshots are available, the users can shoot and catch the football between each other allowing for a game of catch.

16 Claims, 4 Drawing Sheets

(56) References Cited

U.S. PATENT DOCUMENTS

| | | | | |
|---|---|---|---|---|
| 9,091,514 | B1 * | 7/2015 | Cummings | F42B 6/02 |
| D738,440 | S * | 9/2015 | Cummings | D21/571 |
| 9,310,171 | B2 * | 4/2016 | Cummings | F42B 6/02 |
| 9,341,448 | B2 * | 5/2016 | Cummings | A63F 9/0278 |
| 9,395,141 | B2 * | 7/2016 | Cummings | F41B 5/0094 |
| 9,476,666 | B1 * | 10/2016 | Larner | F41B 5/1403 |
| 2003/0027672 | A1 * | 2/2003 | Leal | A63B 43/00 473/613 |
| 2006/0025254 | A1 * | 2/2006 | Myers | A63B 43/06 473/613 |
| 2009/0011870 | A1 * | 1/2009 | Neal | A63B 43/00 473/451 |
| 2012/0060807 | A1 * | 3/2012 | Walterscheid | F41B 5/12 124/20.3 |
| 2012/0160224 | A1 * | 6/2012 | Walterscheid | F41B 5/0094 124/20.1 |
| 2013/0167819 | A1 * | 7/2013 | Walterscheid | F41B 3/02 124/20.1 |
| 2013/0263838 | A1 * | 10/2013 | Cummings | F41B 5/0094 124/20.1 |
| 2014/0000577 | A1 * | 1/2014 | Cummings | A63F 9/0252 124/20.1 |
| 2014/0235380 | A1 * | 8/2014 | Martino | A63B 43/002 473/613 |
| 2014/0338647 | A1 * | 11/2014 | Cummings | F41B 7/08 124/20.3 |
| 2015/0176940 | A1 * | 6/2015 | Cummings | F41B 7/08 124/20.3 |

* cited by examiner

SLINGSHOT FOOTBALL

CROSS-REFERENCE TO RELATED APPLICATIONS

This non-provisional patent application claims priority to the following U.S. provisional applications the entire contents of which are fully incorporated herein with these references: provisional application 62/147,604 filed on Apr. 15, 2015; provisional application 62/149,500 filed on Apr. 17, 2015; and provisional application 62/151,845 filed on Apr. 23, 2015.

FIELD OF THE INVENTION

The present invention generally relates to balls which are thrown and/or caught between users/players. More particularly, the present invention relates to a football or baseball which is launched by a slingshot by the thrower/pitcher and then can still be caught by a receiver/catcher.

BACKGROUND OF THE INVENTION

The applicant/inventor of the current application has experience with the following other inventions described and shown in the following listed U.S. applications the contents of which are fully incorporated herein by these references: application Ser. No. 13/046,089 filed on Mar. 11, 2011 (generally referred to as the Jetball); application Ser. No. 14/261,563 filed on Apr. 25, 2014 (generally referred to as the Raptor Football); application Ser. No. 14/846,772 filed on Sep. 6, 2015 (generally referred to as the Halo Football); and application Ser. No. 15/080,505 filed on Mar. 24, 2016 (generally referred to as the HLG football). Rather than repeating the information of these applications herein, it is understood that all of the lesson learned and concepts disclosed in these previous applications are now applicable to the present invention. Furthermore, the applicant has kept consistency between the numerals and wording of applications Ser. Nos. 13/046,089, 14/261,563 and 15/080,505 with now the current application such that uniformity between these applications are maintained.

The applicant is always looking to develop novel and unique flying products and/or toys that are innovative in design and have outstanding performance. The inventor realized that it could be possible to launch a specially designed football (or baseball) from a slingshot and then be caught by a second person a long distance away. The second person could then launch the football (or baseball) back to the first person if they also had a slingshot.

Accordingly, the applicant realized a need existed for a novel and unique play pattern combining footballs/baseballs and slingshots. The present invention fulfills these needs and provides other related advantages.

SUMMARY OF THE INVENTION

An exemplary embodiment of the present invention includes a launching and/or catching toy kit having a football and at least one slingshot. The football includes: (a) a generally elongated spheroidal body defined as including a longitudinal axis, where a length of the body along the longitudinal axis between a front end of the body to a back end of the body is longer than an equatorial diameter; (b) a support non-movably attached to the body, where a first end of the support is disposed within the body and a second end of the support extends beyond the back end of the body; (c) a tail attached to the second end of the support; (d) a first and a second elastic band catch oppositely disposed about the longitudinal axis and attached to the body and/or the support. The slingshot is associated with the football. The slingshot is configured to launch the football from a first user to a second user. The slingshot includes: (a) a handle configured to be gripped by the first user; (b) a pair of prongs connected and/or extending from a top of the handle, wherein the pair of prongs form an opening wherein the opening is at least as wide as a maximum width of the football; (c) at least one elastic band connected to each prong of the pair of prongs. Each of the at least one elastic band is releasably captured by its respective first or second elastic band catch/receiver/hook/extension on the football during launching by the first user.

In other embodiments the tail may include a twisted shape configured to induce a spin of the football after launching. The tail may extend outwardly in a vertical plane aligned along the longitudinal axis which is generally perpendicular to a horizontal plane which is aligned along the longitudinal axis but also extends through the first and second elastic band catch. The tail may include a finger grip feature configured to be easily grasped by the first user when launching.

A wrist lasso may be attached to a bottom of the handle, wherein the wrist lasso is configured to be wrapped and/or placed around a wrist of the first user.

The pair of prongs may be pivotably/rotatably connected to the handle. At least one spring may be disposed between the pair of prongs and the handle biasing the pair of prongs to move out of the path of the football when released by the first user during launching.

The support may not be disposed through the front end of the body.

The equatorial diameter may be at least 2.0, 2.5, 3.0, 3.5 or 4.0 inches.

At least a portion of the front end of the body may include a Shore A durometer hardness substantially equal to or less than 25.

At least the front end of the body may be football shaped.

An overall weight of the football may be less than 50, 100, 150, 200, 250, 300, 350 or 400 grams. The lighter the football the better as it will be easily accelerated upon launch.

The support may comprise a hollow aluminum tube. The aluminum tube may be at least 15 mm or greater in diameter. The aluminum used may be 7075-T6.

A lift-generating wing may be non-movably attached to the support. The lift-generating wing may disposed behind a center of the body in relation to along the longitudinal axis or wherein an outside contiguous envelope of the body does not coincide with any portion of an outside contiguous envelope of the lift-generating wing or wherein the body and lift-generating wing are separately disposed.

A floor stand may be attached to a bottom of the body, where the floor stand is configured to stabilize the football in a fixed position when the football is placed upon a generally horizontal surface.

The lift-generating wing may comprise a dihedral angle of at least 5, 10, 15, 20, 25 or 30 degrees.

A horizontal stabilizer may be disposed behind the lift-generating wing attached to the support and/or the tail. The horizontal stabilizer may comprise a downward force producing horizontal stabilizer which creates a nose-up pitch of the football in flight. A manual adjuster may be associated with the horizontal stabilizer, the manual adjuster controlling a shape of the horizontal stabilizer, where the manual adjuster is mechanically engaged between the horizontal stabilizer on one side and the support or tail on the other side. The manual adjuster may comprise a hand-turnable threaded fastener.

The lift-generating wing may comprise a generally convex upper surface opposite a generally concave lower surface, where the upper and lower surfaces define a wing thickness. The wing thickness may be less than 0.10 of an inch. The lift-generating wing may comprise an injection molded, non-foamed, polymer wing.

The body may be comprised of a front section abutting a rear section, where the front section and rear section comprise different materials and where a rear section volume is at least double a front section volume.

At least one divot may be disposed within the body behind the first or second elastic band catch.

An exemplary embodiment of the present invention includes a launching and/or catching toy kit having a football and at least one slingshot. The football includes: (a) a generally elongated spheroidal body defined as comprising a longitudinal axis, where a length of the body along the longitudinal axis between a front end of the body to a back end of the body is longer than an equatorial diameter; (b) a support non-movably attached to the body, where a first end of the support is disposed within the body and a second end of the support extends beyond the back end of the body; (c) a vertical tail attached to the second end of the support; (d) a horizontal tail attached to the support; (e) a lift-generating wing non-movably attached to the support; (f) an elastic band catch oppositely disposed about a bottom of the body and attached to the body and/or the support. The slingshot is associated with the football. The slingshot is configured to launch the football from a first user to a second user. The slingshot includes: (a) a handle configured to be gripped by the first user; (b) a pair of prongs connected and/or extending from a top of the handle, wherein the pair of prongs form an opening wherein the opening is at least as wide as a maximum width of the football; (c) at least one elastic band connected to at least one prong of the pair of prongs. The at least one elastic band is releasably captured by the elastic band catch on the football during launching by the first user.

An exemplary embodiment of the present invention includes a launching and/or catching toy kit including a baseball and a slingshot. The baseball includes: (a) a spherical body; (b) a support non-movably attached to the body, where a first end of the support is disposed within the body and a second end of the support extends beyond the back end of the body; (c) a tail attached to the second end of the support; and (d) at least one elastic band catch attached to the body and/or the support. The slingshot is associated with the baseball, where the slingshot is configured to launch the baseball from a first user to a second user. The slingshot includes: (a) a baseball glove attachment feature configured to be attached to a baseball glove worn by the first user; (b) a pair of prongs connected and/or extending from the baseball glove attachment feature, wherein the pair of prongs form an opening; and (c) at least one elastic band connected to the pair of prongs. The at least one elastic band is releasably captured by the elastic band catch on the baseball during launching by the first user.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
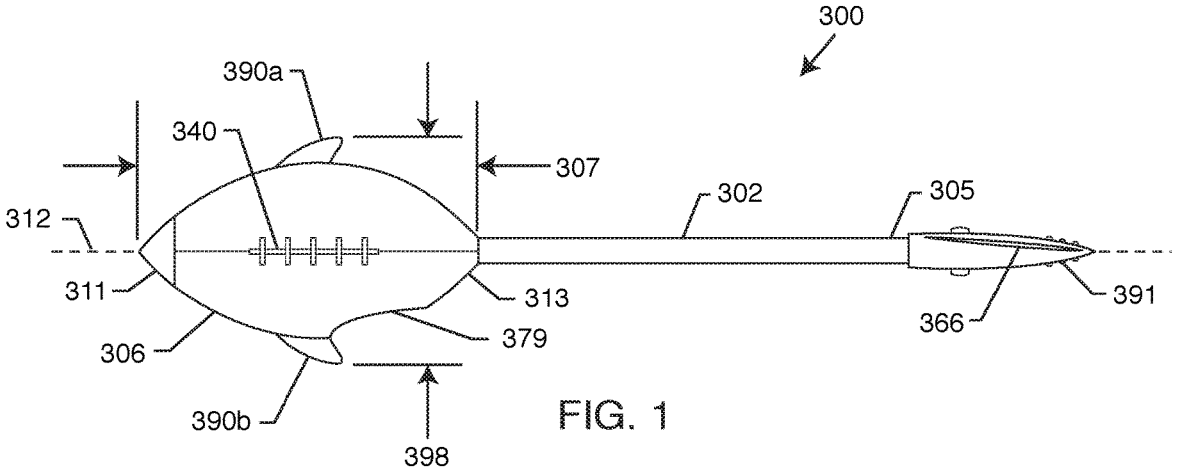
FIG. 1 is a top view of an exemplary embodiment of the present invention showing a novel football design which can be launched by a slingshot.
Figure 2:
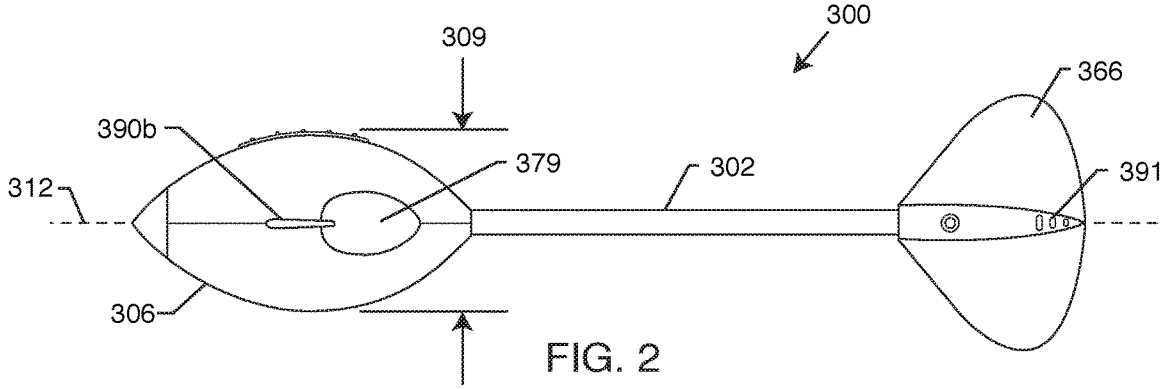
FIG. 2 is a side view of the structure of FIG. 1.

As shown in FIGS. 1 and 2, an exemplary embodiment of the present invention includes a launching and/or catching toy kit having a football 300 and at least one slingshot 388. The football 300 includes a generally elongated spheroidal body 306 defined as including a longitudinal axis 312, where a length 307 of the body 306 along the longitudinal axis between a front end 311 of the body to a back end 313 of the body is longer than an equatorial diameter 309.

Figures 4, 5, 6:
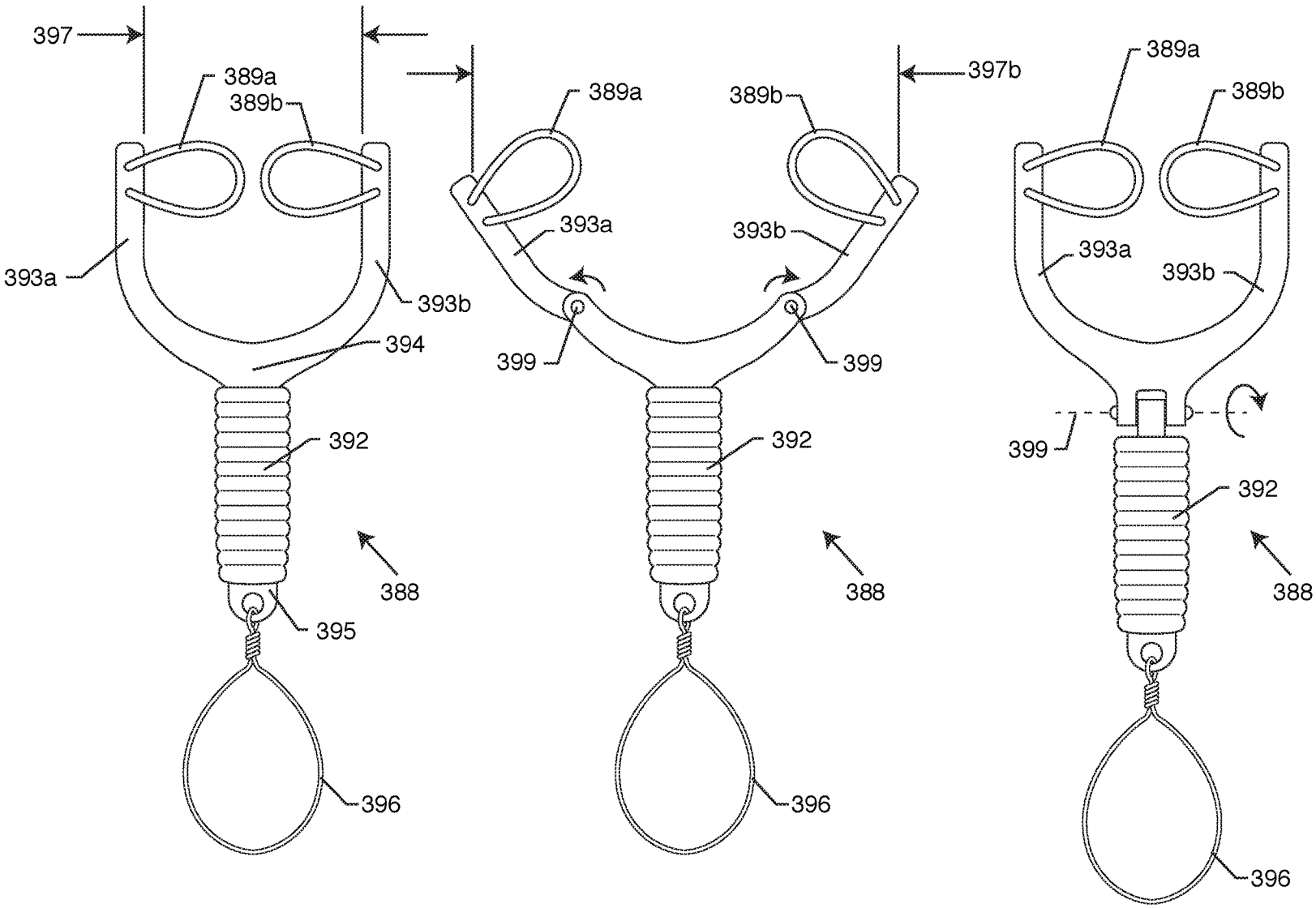
FIG. 4 is a front view of an exemplary embodiment of a novel slingshot.
FIG. 5 is a front view of another exemplary embodiment of a novel slingshot.
FIG. 6 is a front view of another exemplary embodiment of a novel slingshot.

A support 302 is non-movably attached to the body 306, where a first end 303 (best shown in FIG. 6 of application Ser. No. 15/080,505) of the support 302 is disposed within the body 306 and a second end 305 of the support extends beyond the back end of the body 306. As discussed in the previous applications, the support 302 may be made from a variety of materials. Here, the support 302 may comprise a hollow aluminum tube. The aluminum tube may be at least 15 mm or greater in diameter. The aluminum used may be 7075-T6 aluminum alloy. It is typical for the support 302 to end within the body 306 such that the support may not be disposed through the front end 311 of the body 306. Or, the support may be attached to the back end of the football body.

Not shown in this application, but taught in application Ser. Nos. 15/080,505 and 14/261,563, an impact transfer surface 364 of an impact transfer part 365 may be attached to the first end 303 of the support 302. Furthermore, the body 306 may be broken up into a front section 308 and a rear section 310. It is then easily facilitated that at least a portion of the front end of the body may include a Shore A durometer hardness substantially equal to or less than 25. A soft front end of the body 306 helps to reduce shock loads to the rest of the football while also reducing chance of injury to the users.

A tail (i.e. vertical tail) 366 is attached to the second end of the support. As shown in FIG. 1 the tail 366 may include a twisted shape configured to induce a spin of the football 300 after launching. The tail 366 may extend outwardly in opposite directions in a vertical plane aligned along the longitudinal axis 312 which is generally perpendicular to a horizontal plane which is aligned along the longitudinal axis but also extends through the first and second elastic band catch 390*a* and 390*b*.

Another feature shown as part of the tail 366 is a finger grip feature 391 configured to be easily grasped by the first user when launching. The finger grip feature 391 can take on many forms. For example, the finger grip feature can be raised or lowered features embedded and/or integrated into the design of the tail 366. The finger grip feature 391 can include textured adhesives or the like that allow one to get a strong grip onto the tail 366.

A first elastic band catch 390*a* and a second elastic band catch 390*b* are oppositely disposed about the longitudinal axis 312 and are attached to the body and/or the support. As shown herein, the catches 390 are disposed along the body 306 of the football 300.

FIG. 1 shows two different options where the catch 390*b* includes a divot (recess) 379 which may be disposed within the body 306 behind the catch 390*b* or not include a divot 379 as shown with catch 390*a*. The reason for the divot is to facilitate ease of preparing the football 300 for launching as will be understood when used in conjunction with a slingshot 388.

The slingshot 388 is associated with the football and is used to launch the football 300. Typically, a football is thrown manually by the user/thrower/quarterback. However, the applicant believes that a football 300 can be designed such that it can be launched even further by a slingshot 388. Therefore, the slingshot 388 is configured to launch the football 300 from a first user to a second user. When the second user/receiver also has a second slingshot 388, the receiver can then become the thrower and launch the football back to the first user. In this manner two people (or more) can be launching footballs back and forth there between simulating the game of catch.

The slingshot 388 includes a handle 392 configured to be gripped by the first user. The handle 392 can be made of plastic, composites, wood or the like. The handle 392 can also include a foam cover to provide a comfortable grip to the user. A pair of prongs 393*a* and 393*b* are connected and/or extending from a top 394 of the handle. The pair of prongs 393 form an opening 397 wherein the opening 397 is at least as wide as a maximum width 398 of the football 300. At least one elastic band 389 is connected to each prong of the pair of prongs.

It is understood by those skilled in the art that the bands 389 can be made from rubber, elastic material or the like. The material used can be similar or the same to the material used for current slingshots on the market today. It is understood that these bands are flexibly resilient and store energy when pulled taught and release energy when let go. In this way one is able to create a launching action with the present invention.

The opening 397 has to be at least as large as the maximum width 398 of the football 300 such that it can easily be launched by the user. To aid in a smooth launch, each of the at least one elastic band 389 is releasably captured by its respective first or second elastic band catch 390 on the football during launching by the first user. As can be seen when comparing FIGS. 1 and 4, the catch 390 is shaped to capture the band 389 when pulled in one direction but not in the other direction. The catch 390 can also be described as a receiver, a hook, an extension or other like terms.

A wrist lasso 396 may be attached to a bottom 395 of the handle 392. The wrist lasso 396 is configured to be wrapped and/or placed around a wrist of the first and/or second user. The lasso 396 serves an important purpose, as it allows a user the ability to quickly drop the slingshot 388 and prepare to catch the football when the football is being launched in return. Otherwise, the user would need to put down the slingshot 388 or place the slingshot 388 into one's pocket or the like. The lasso 396 allows quick release and regrip of the slingshot 388 such that increased play is facilitated.

As shown in FIGS. 5 and 6, the pair of prongs 389 may be pivotably connected to the handle 392. In FIG. 5, each prong 389 is pivotable away such that a larger opening 397*b* is created. Each prong would include its own spring or bias located at each pivot point 399 that biases the prongs into the larger opening 397*b*. The larger opening 397*b* allows an even easier release of the football 300 when launched.

FIG. 6 also includes a pivot 399 between the handle and both prongs 389. In this case, both prongs pivot together and would pivot away from the football when launched. Similarly to FIG. 5, a spring or bias would be connected/attached between the handle and the prongs. One will understand that the spring would bias the slingshot 388 such that the handle 388 and prongs 389 would be perpendicular to one another when not in use. Only when the football was being pulled backwards for launch would then the slingshot 388 take the appearance as shown in FIG. 6. In this way, both prongs 389*a* and 389*b* would fold downwardly when the football was launched and move out of the way/path of the football 300 when released by the first user during launching.

The smaller the equatorial diameter 309 of the football 300 is, the less drag it will experience in the air. However, this also means the football 300 will be harder to catch. Therefore, a balance between the two must be achieved. Therefore, the equatorial diameter may be at least 2.0, 2.5, 3.0, 3.5 or 4.0 inches.

At least the front end 311 of the body may be football shaped. Alternatively, other shapes can be used such as missiles, rockets, torpedoes and the like.

The lighter the football is the easier and farther it will be launched. Therefore, an overall weight of the football may be less than 50, 100, 150, 200, 250, 300, 350 or 400 grams.

Figure 3:
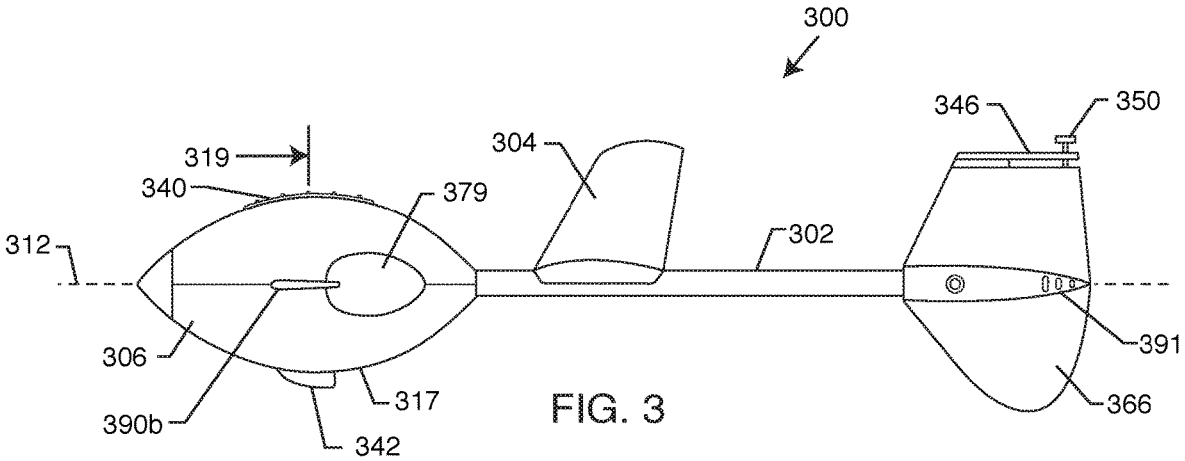
FIG. 3 is a side view of another exemplary embodiment of the present invention showing a novel football design which can be launched by a slingshot.

FIG. 3 is yet another embodiment of the present invention. FIG. 3 combines the various features previously described with the teachings of application Ser. No. 14/261,563. More specifically, a lift-generating wing 304 may be non-movably attached to the support 302. The lift-generating wing 304 may disposed behind a center 319 of the body 306 in relation to along the longitudinal axis 312. Said differently, an outside contiguous envelope of the body 306 does not coincide with any portion of an outside contiguous envelope of the lift-generating wing 304. Said differently yet again, the body 306 and lift-generating wing 304 are separately disposed.

A floor stand 342 may be attached to a bottom 317 of the body 306, where the floor stand 342 is configured to stabilize the football 300 in a fixed position when the football is placed upon a generally horizontal surface.

The lift-generating wing may comprise a dihedral angle 332 of at least 5, 10, 15, 20, 25 or 30 degrees as previously taught in the prior mentioned applications.

A horizontal stabilizer 346 may be disposed behind the lift-generating wing 304 attached to the support 304 and/or the vertical tail 366. As shown in FIG. 3, the horizontal stabilizer 346 is placed upon the vertical tail 366 such that it clears the prongs 393 of the slingshot 388.

The horizontal stabilizer 346 may comprise a downward force producing horizontal stabilizer which creates a nose-up pitch of the football in flight. More specifically, a manual adjuster 350 may be associated with the horizontal stabilizer. The manual adjuster 350 controls a shape of the horizontal stabilizer, where the manual adjuster is mechanically engaged between the horizontal stabilizer on one side and the support or tail on the other side. The manual adjuster may comprise a hand-turnable threaded fastener that engages into a nut or threads into the horizontal stabilizer itself.

The lift-generating wing 304 may comprise a generally convex upper surface 360 opposite a generally concave lower surface 362, where the upper and lower surfaces define a wing thickness. The wing thickness may be less than 0.10 of an inch. The lift-generating wing may comprise an injection molded, non-foamed, polymer wing. These features were covered extensively in the previously mentioned applications.

The body 306 may be comprised of a front section 308 abutting a rear section 310, where the front section and rear section comprise different materials and where a rear section volume is at least double a front section volume. These features were covered extensively in the previously mentioned applications.

Figure 7:
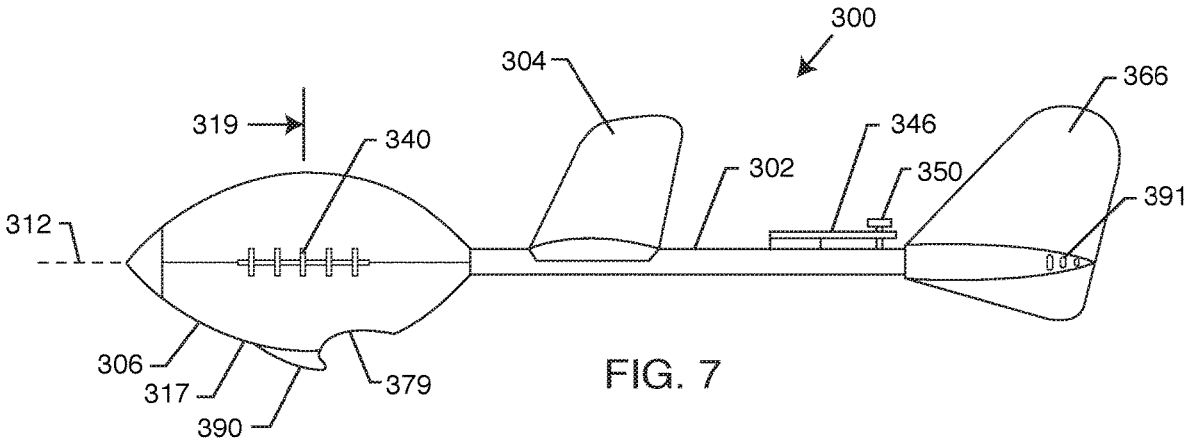
FIG. 7 is a side view of another exemplary embodiment of the present invention showing a novel football design which can be launched by a slingshot.
Figure 8:
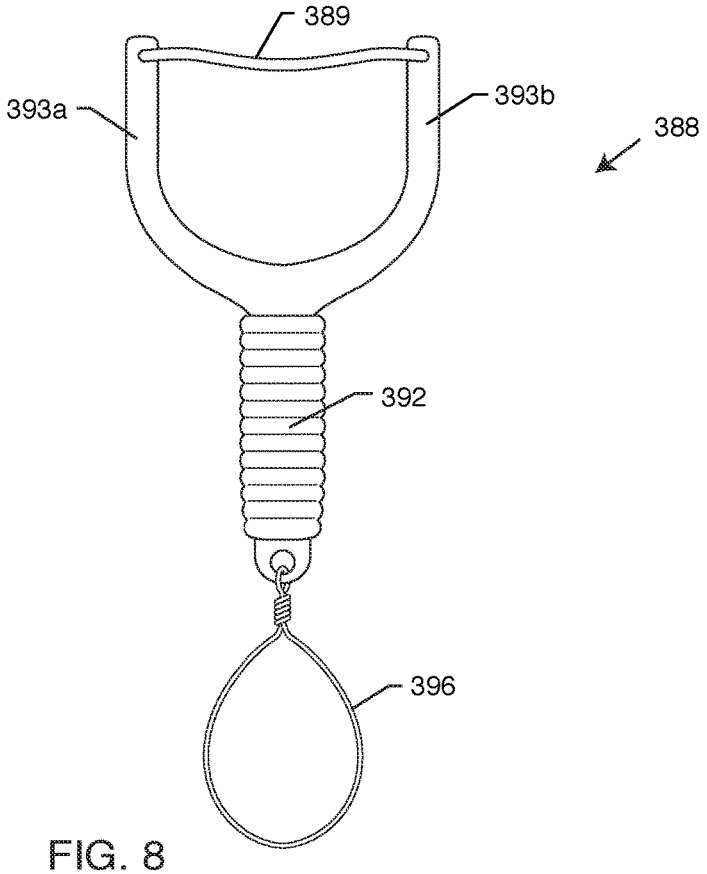
FIG. 8 is a front view of another exemplary embodiment of a novel slingshot.

FIG. 7 is yet another embodiment of a football 300 of the present invention that is designed to go with the slingshot 388 shown in FIG. 8. Here, the elastic band catch 390 is disposed at the bottom 317 of the body 306. The divot 379 is optional. Now that the catch 390 is at the very most bottom of the body 306, the slingshot 388 may utilize a single elastic band 389 that attaches to both prongs 393*a* and 393*b*. Furthermore, the horizontal stabilizer 346 is shown now attached to the support 302. Accordingly, this design of the football 300 no longer has to fully pass within the opening 397 as previously shown. Rather, the football 300 stays above a majority of the prongs of the slingshot. One disadvantage is that the center of gravity of the football 300 is no longer aligned with the catch 390. Therefore, the user may have to adjust his launching technique to account for this differential.

For clarification, the references in this application to "football" are referring to American football and not the game of soccer.

Figure 9:
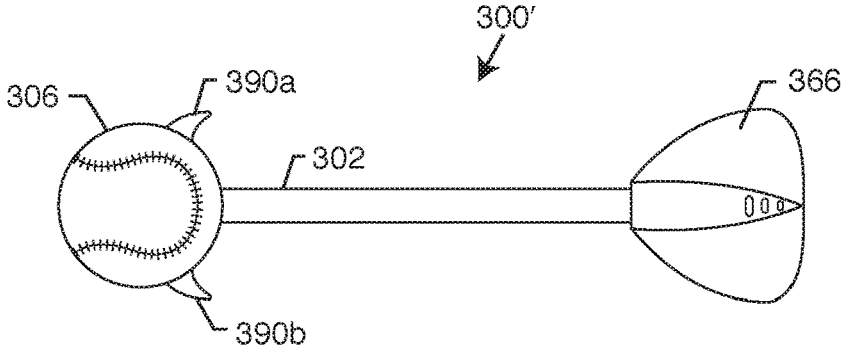
FIG. 9 is a top view of an exemplary embodiment of the present invention showing a novel baseball design which can be launched by a slingshot.
Figure 10:
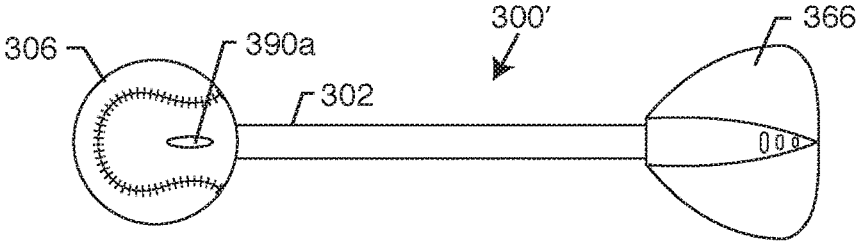
FIG. 10 is a side view of the structure of FIG. 9.
Figure 12:
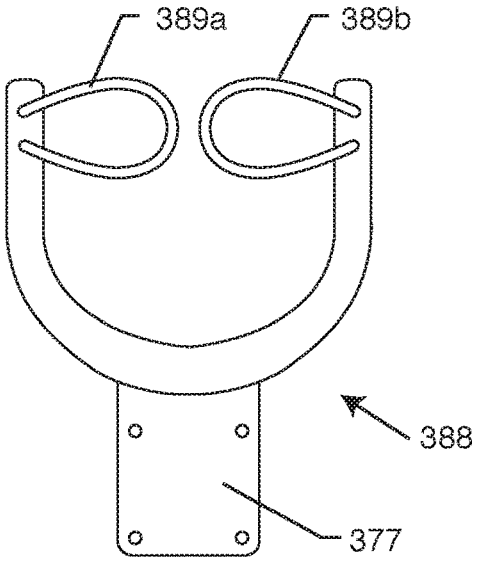
FIG. 12 is a front view of another exemplary embodiment of a novel slingshot for attachment to a baseball glove.

While all of the embodiments shown herein are football like in nature, it is also understood by those skilled in the art that the body 306 may be shaped like a baseball and the ball 300' could function in a very similar manner. FIGS. 9 and 10 show an embodiment of a baseball 300' where the body 306 is now in the shape of a baseball and there are two elastic band catches 390*a* and 390*b*. This embodiment is then meant to be used with the slingshot 388 of FIG. 12. Where the handle of the slingshot would normally reside is now a glove attachment feature 377. The glove attachment feature 377 may be configured to attach with a clip or with fasteners to any portion of a standard baseball glove. For example, the glove attachment feature 377 can utilize fasteners or the like that are placed through and/or around the webbing of a baseball glove. In this way the slingshot 388 now becomes an integral part of the baseball glove. The slingshot 388 may be a separate part attached to a baseball glove or a custom baseball glove can be designed such that the slingshot is integrated into it in a seamless manner. As can be understood by those skilled in the art, there are many structures and methods that may be used to attach the slingshot to a baseball glove.

Figure 11:
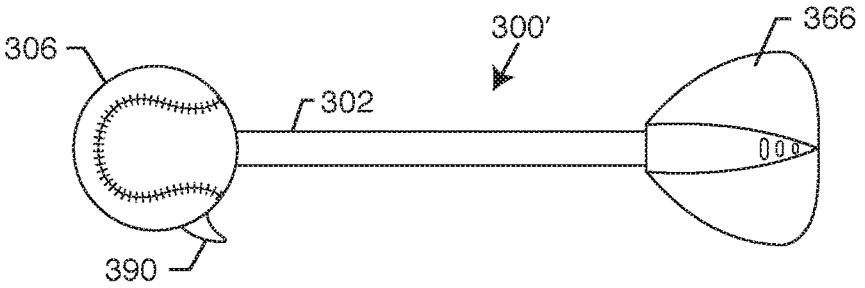
FIG. 11 is a side view of another exemplary embodiment of the present invention showing a novel football design which can be launched by a slingshot.
Figure 13:
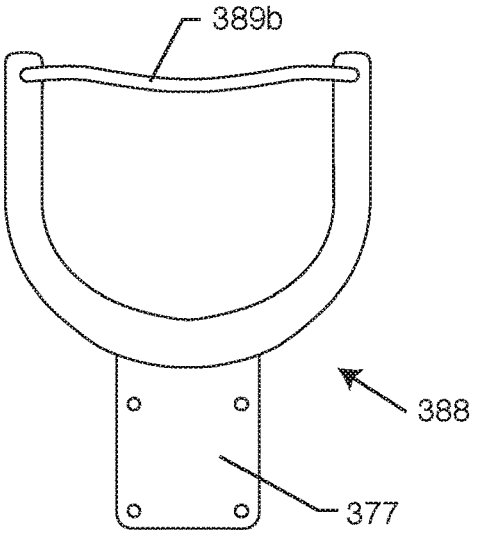
FIG. 13 is a front view of another exemplary embodiment of a novel slingshot for attachment to a baseball glove.

FIG. 11 is an embodiment of a baseball where now only one elastic band catch 390 is used. This baseball 300' is intended to be used with the slingshot shown in FIG. 13 where only one elastic band 389 is needed.

In another embodiment not shown, the lift-generating wings 304 and horizontal stabilizer 346 may be attached to the baseball versions such that now the balls 300' can achieve true flight.

In another embodiment not shown, the support 302 can be configured to telescope such that after launching, the support shrinks in overall length. This then would allow a shorter overall ball to fly through the air better simulating either the traditional football or baseball profiles.

In another embodiment, the body 306, the support 302 and the tail 366 can be made as one single part from the same material. For example, the body, support and tail may be injected molded as a foam part such as EPS or EPP. The advantage of this is that the foam is extremely light while still being sufficiently rigid. The low weight would aid in achieving fast velocities upon launch. To reinforce the foam, stickers can be placed along the outside of the structure such that the stickers add tensional strength to the football during launch and prevent abrasions to the surface of the foam when landing or crashing. The elastic band catches 390 can be integrated into the foam structure or alternatively formed from a separately manufactured injection molded plastic that is then attached to the foam body.

Although several embodiments have been described in detail for purposes of illustration, various modifications may be made to each without departing from the scope and spirit of the invention. Accordingly, the invention is not to be limited, except as by the appended claims.

NUMERALS

300 Launching and/or Catching Flying Toy
302 Structural Support
303 First End of Support
304 Lift-Generating Wing
305 Second End of Support
306 Body
307 Length of Body
308 Front Section
309 Equatorial Diameter
310 Rear Section
311 Front End of Body
312 Longitudinal Axis
313 Back End of Body
314 Tail
315 Front End of Toy
316 Tail Fin
317 Bottom of Body
318 Tail End
319 Center of Body
320 Thumb Grip
321 Top of Body
322 Bearing
323 Inside Surface of Front Section
324 Pitch Axis
325 Left Wing Portion
326 Pivot
327 Right Wing Portion
328 Screw
329 Distal End of Wing

330 Bias
331 Fastener
332 Dihedral Angle
334 Horizontal Section
336 Dihedral Section
338 Vacuum-Formed Plastic Part
340 Laces
342 Floor Stand
343 Protrusions on Floor Stand
344 Wing Centerline
346 Horizontal Stabilizer
348 Center of Gravity
349 Notch
350 Manual Adjuster
351 Nut
352 Nut Recess
353 Wall Stand Apertures
354 Push Surface
356 Spinner
357 Bearing
358 Rear Brace
359 Distance
360 Convex Upper Surface
362 Concave Lower Surface
364 Impact Transfer Surface
365 Impact Transfer Part
366 Vertical Stabilizer
368 Wing Bracket
370 Male-to-Female Connection
372 Male Portion
374 Female Portion
376 Recess
377 Glove Attachment Feature
378 Finger Extensions
379 Divot
380 Finger Hold Extensions
381 Counterweight
382 Horizontal Plane
383 Upper Extension, Finger Hold Extension
384 Lower Extension, Finger Hold Extension
385 User's Hand
386 Vertical End, Upper Extension
387 Vertical End, Lower Extension
388 Slingshot
389 Elastic Band
390 Elastic Band Catch
391 Finger Grip Feature
392 Handle
393 Prong
394 Top of Handle
395 Bottom of Handle
396 Lasso
397 Opening Between Prongs
398 Maximum Width, Football
399 Pivot

What is claimed is:

1. A launching and/or catching toy kit, comprising:

a football comprising:

a) a generally elongated spheroidal body defined as comprising a longitudinal axis, where a length of the body along the longitudinal axis between a front end of the body to a back end of the body is longer than an equatorial diameter, wherein the equatorial diameter is at least 2 inches;

b) a support non-movably attached to the body, where a first end of the support is disposed within the body or attached to the body and a second end of the support extends beyond the back end of the body;

c) a tail attached to the second end of the support;

d) a first and a second elastic band hook oppositely disposed about the longitudinal axis and attached to the body and/or the support;

at least one divot disposed within the body behind the first or second elastic band hook; and at least two slingshots associated with the football, each slingshot configured to launch the football from a first user to a second user or from the second user to the first user, each slingshot comprising:

a) a handle configured to be gripped by the first or second user;

b) a pair of prongs connected and/or extending from a top of the handle, wherein the pair of prongs form an opening wherein the opening is at least as wide as a maximum width of the football;

c) at least one elastic band connected to each prong of the pair of prongs;

wherein each at least one elastic band is releasably captured by its respective first or second elastic band hook on the football during launching by the first or second user.

2. The toy kit of claim 1, wherein the tail comprises a twisted shape configured to induce a spin of the football after launching.

3. The toy kit of claim 1, wherein the tail extends outwardly in a vertical plane aligned along the longitudinal axis which is generally perpendicular to a horizontal plane which is aligned along the longitudinal axis but also extends through the first and second elastic band hook, and wherein the tail does not extend outwardly along the horizontal plane.

4. The toy kit of claim 1, wherein the tail comprises a finger grip feature formed as a continuous part of the tail, the finger grip feature configured to be easily grasped by the first user when launching.

5. The toy kit of claim 1, including a wrist lasso attached to a bottom of the handle, wherein the wrist lasso is configured to be wrapped and/or placed around a wrist of the first user.

6. The toy kit of claim 1, wherein the support is not disposed through the front end of the body.

7. The toy kit of claim 1, wherein at least a portion of the front end of the body comprises a Shore A durometer hardness substantially equal to or less than 25.

8. The toy kit of claim 1, wherein at least the front end of the body is football shaped.

9. The toy kit of claim 1, wherein an overall weight of the football is less than 100 grams.

10. The toy kit of claim 1, wherein the support comprises a hollow aluminum tube.

11. The toy kit of claim 1, wherein the body is comprised of a front section abutting a rear section, where the front section and rear section comprise different materials and where a rear section volume is at least double a front section volume.

12. The toy kit of claim 1, wherein the body, support and tail are made as a single manufactured part from the same material.

13. The toy kit of claim 1, wherein the equatorial diameter is at least 2.5 inches.

14. The toy kit of claim 1, wherein the equatorial diameter is at least 3.0 inches.

15. The toy kit of claim 1, wherein the equatorial diameter is at least 3.5 inches.

16. The toy kit of claim 1, wherein the equatorial diameter is at least 4.0 inches.

* * * * *